United States Patent [19]

Runo

[11] 4,142,667

[45] Mar. 6, 1979

[54] SEALABLE LONGITUDINAL SLEEVELESS VALVE BAG

[76] Inventor: William R. Runo, 7010 S. Windsor, Littleton, Colo. 80123

[21] Appl. No.: 818,900

[22] Filed: Jul. 25, 1977

[51] Int. Cl.[2] ..... B65D 31/14; B31B 49/04

[52] U.S. Cl. ..... 229/62.5; 93/35 R

[58] Field of Search ..... 229/62, 62.5, 55, 7 R, 229/17 G, 76; 93/35 R

[56] References Cited

U.S. PATENT DOCUMENTS

| | | | |
|---|---|---|---|
| 1,070,790 | 8/1913 | Falk | 229/62 |
| 2,093,977 | 9/1937 | Farmer | 229/7 R |
| 2,162,285 | 6/1939 | Scott | 229/62 |
| 2,202,879 | 6/1940 | Wentz | 229/62 |
| 2,219,198 | 10/1940 | Reineman | 229/62 |
| 2,226,943 | 12/1940 | Poppe | 229/62 |
| 2,555,526 | 6/1951 | Zinn, Jr. | 229/17 G |
| 2,639,028 | 5/1953 | Stern | 229/62 |
| 2,993,630 | 7/1961 | Cox et al. | 229/17 G |
| 3,009,627 | 11/1961 | Ottinger | 229/62 |
| 4,008,850 | 2/1977 | Goodrich | 229/62 |

FOREIGN PATENT DOCUMENTS

| | | | |
|---|---|---|---|
| 557775 | 5/1958 | Canada | 229/62.5 |

*Primary Examiner*—Stephen P. Garbe

*Attorney, Agent, or Firm*—Leitner, Palan, Martin & Bernstein

[57] ABSTRACT

A bag of tubular form closed at one end and partially closed at the other end by a first rear wall portion being folded over and sealed to a front wall. The opening between a second rear wall portion and opposed front wall forms the valve which is sealed after filling by folding the longitudinally extending second rear wall portion over and sealing it to the opposed front wall using the folded first rear wall portion as a reference. Adjacent lateral termination of the plural ply rear wall portions are oppositely stepped so as to overlap when sealed to the front wall.

26 Claims, 17 Drawing Figures

FIG.1
PRIOR ART
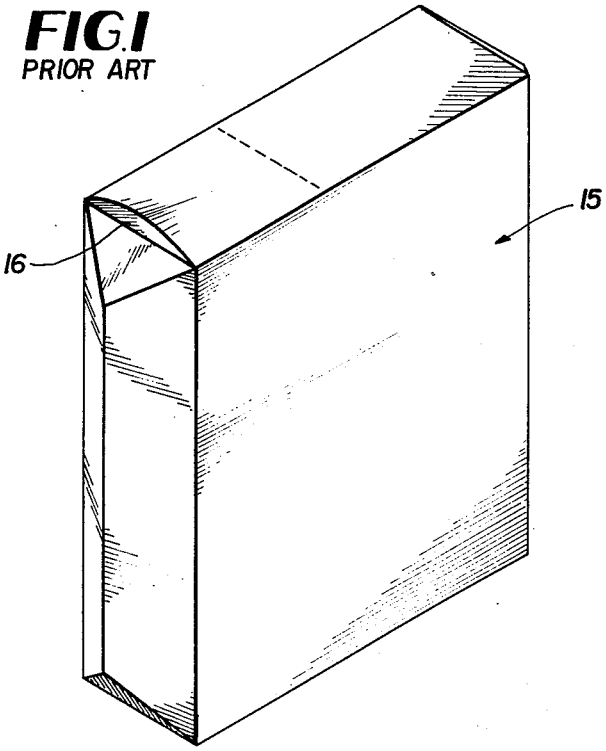
FIG.2
PRIOR ART
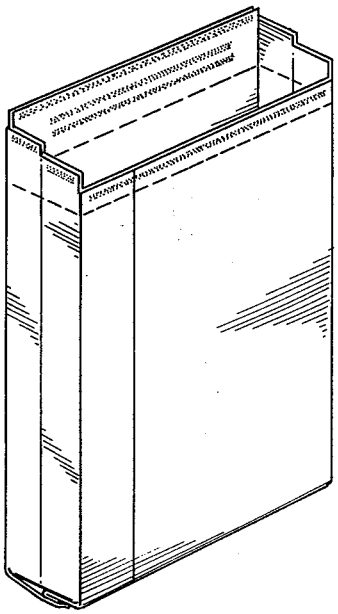
FIG.3
PRIOR ART
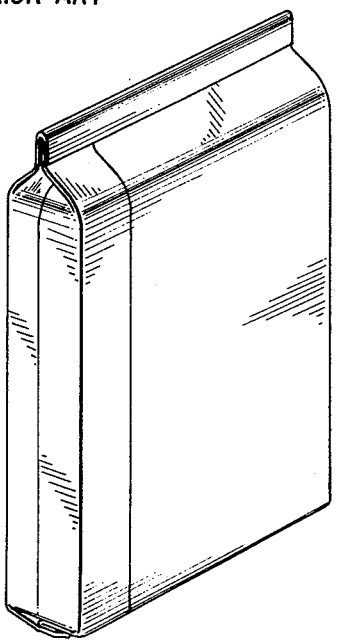
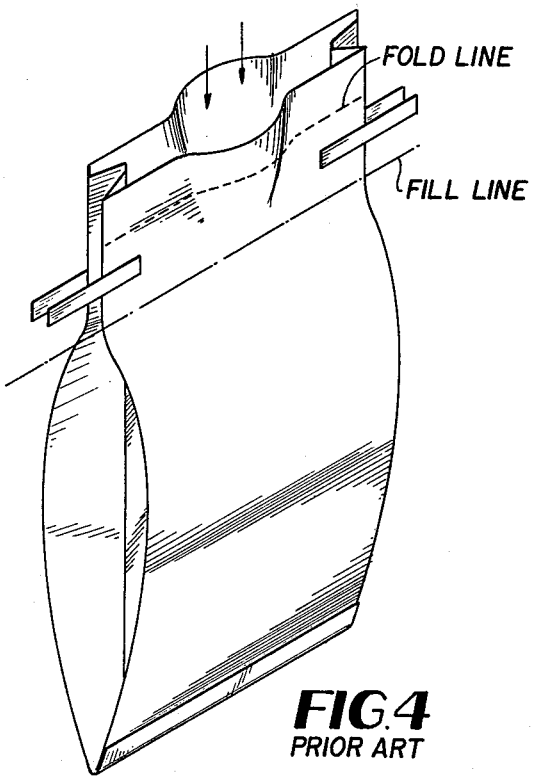
FIG.4
PRIOR ART FIG. 9
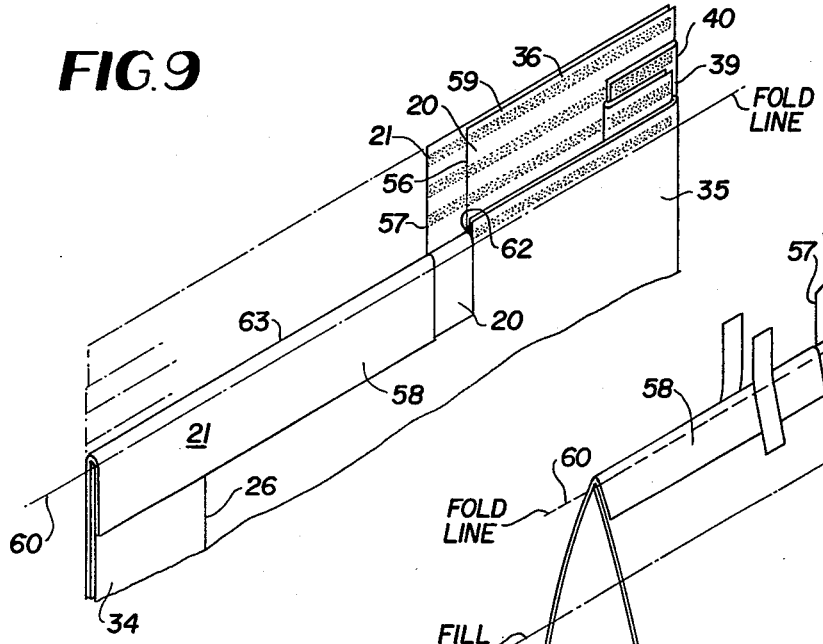
FIG. 10
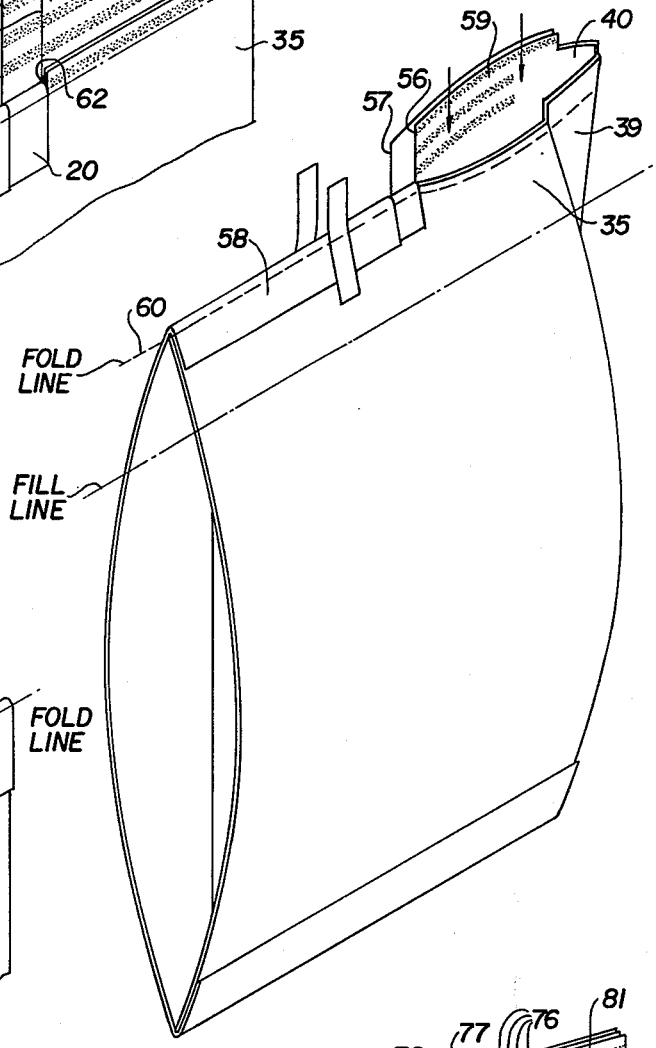
FIG. 11
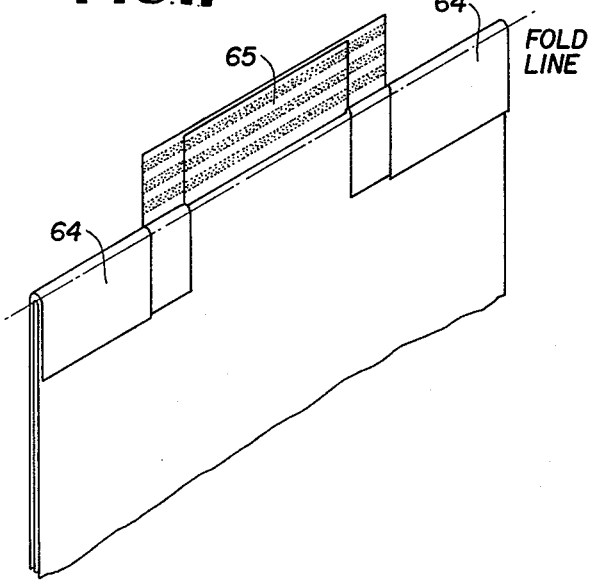
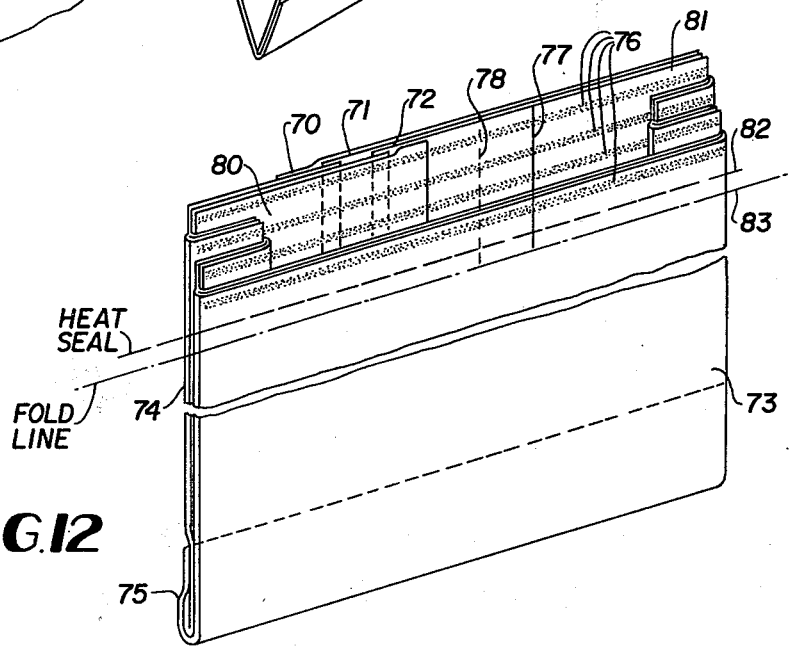
FIG. 12

FIG.13
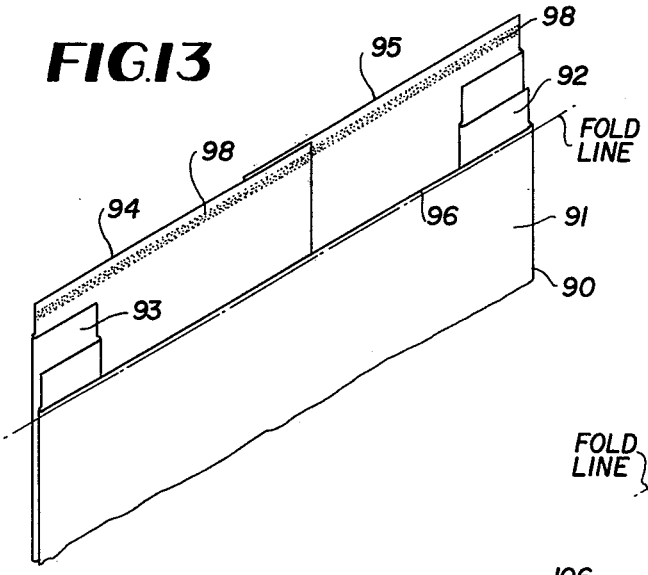
FIG.14
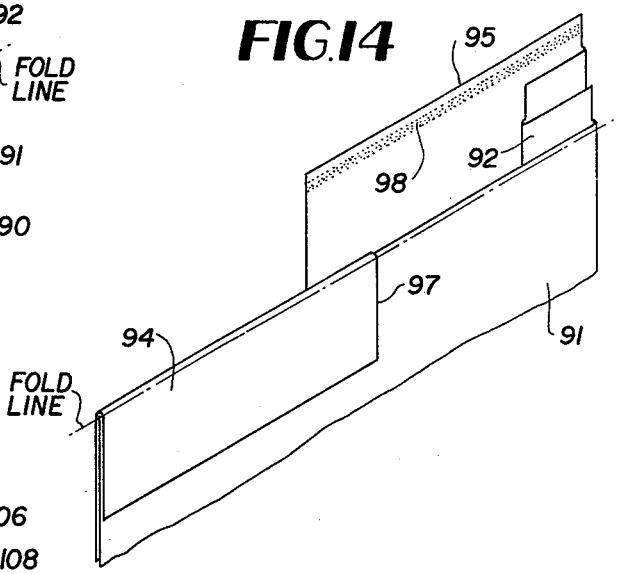
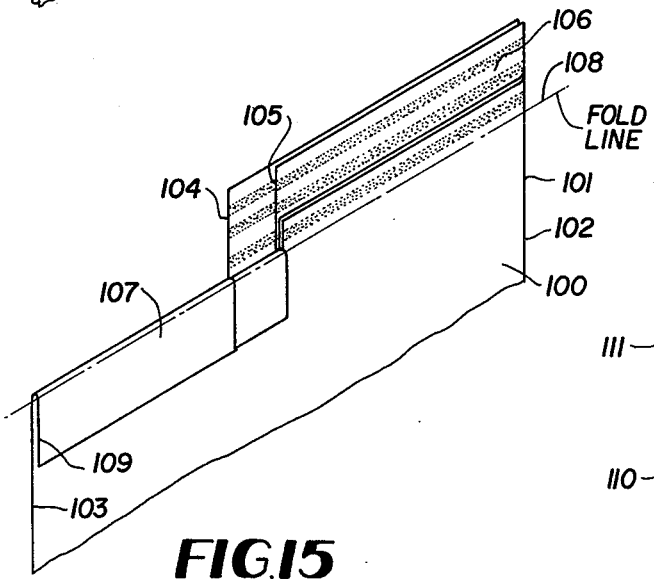
FIG.15
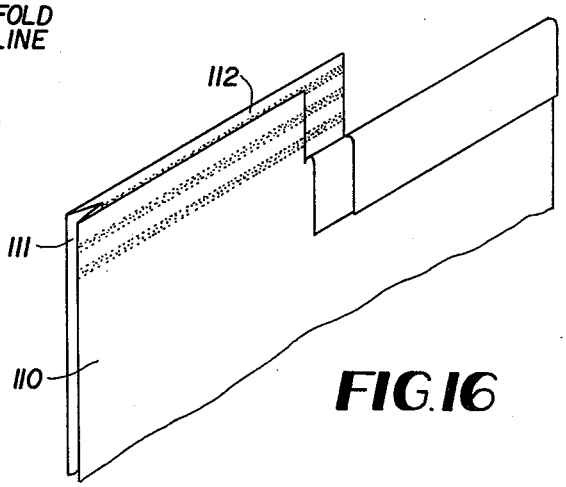
FIG.16
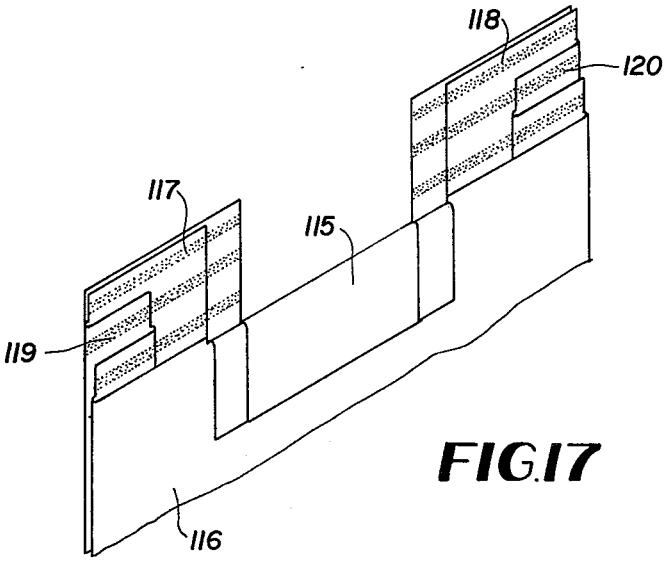
FIG.17

SEALABLE LONGITUDINAL SLEEVELESS VALVE BAG

BACKGROUND OF THE INVENTION

The present invention relates generally to sealed bags and more specifically to a sleeveless valve bag or partially closed open mouthed bag.

Currently, there are two basic types of bags being used in the industrial packaging field; namely, the valve bag and the open-mouth bag. A serious limitation of the valve bag is the inability to achieve a positive closure to prevent leakage and sifting of the product from the bag, to prevent insect infestation and to obtain a hermetical seal. To improve the closure of the seal, the valve opening may be made smaller, but this reduces the filling speed. Thus the designer of valve bags must weigh the positive closure of the valve against the filling speed. A typical valve bag 15 of prior art is illustrated in FIG. 1 having a valve sleeve 16 extending between the interior of the bag and the exterior. The axis of the valve sleeve 16 is on the side of the bag or along the lateral axis. The lateral valve bags may be filled horizontally as is the case in the United States, or vertically as is the case of some foreign countries. Either method of filling a lateral valve bag does not make effective use of the volume of the bag because of the angular repose of the product filling the bag.

Thus there is existing need for a valve bag with an opening large enough to insure maximum filling speed, located to make effective use of the filling rate and bag volume and capable of easily and conveniently being hermetically sealed.

The open mouth bags are either tube style or pinch style wherein the latter provides a better seal. The pinch style, open mouth bag is a gussetted open mouth bag that has a specific type of closure. This closure can, when properly made, provide a hermetical seal. A serious limitation of this specific open mouth bag is that the entire top of the bag is open and after the filling operation is completed, the bag top must be reformed and flattened for entry into a closing and sealing machine. A typical example of prior art open mouth bags in the open and sealed condition are illustrated in FIGS. 2 and 3 respectively.

Due to the nature of the bag construction, the bag top must be level when entered into the closing machine, within a narrow angular tolerence, to insure that the closing operation along the complete bag top width is accomplished properly and the hermetical seal actually obtained. In addition to the level requirement, there must be a wrinkle and warp free bag top surface in the closure to assure a heremetical seal. Since the complete bag top must be reformed and flattened and since the bag tends to be rounded from the material contained, warpage and wrinkles can easily be generated during the reforming operation. To minimize this condition, the level of material, in relation to the bag top edge (known as freeboard), must be low (approximately 9 inches from the top of the bag) to insure a quick, easy and reliable closure and seal. This relationship between the fill line and fold line is illustrated in FIG. 4. Clamps are also schematically shown which hold the gussets formed at the top edge and maintains the top edge horizontally to assure a completely sealed closure. As can be seen, the devices of the prior art in order to assure a perfect seal, drastically reduce the fill opening.

Thus there exists a need for a tube or pinch style, open mouth bag having a large fill opening for a given linear length of top edge, a wide tolerance for bag top level condition for closing and sealing, and reducing the amount of freeboard and consequently paper needed to effect a sealed closure for a given volume of product.

SUMMARY OF THE INVENTION

The bag of the present invention is a longitudinal, sleeveless valve bag formed from a tubular construction of flexible sheet material. The tube is closed at a first or bottom end by folding one wall back over the opposed wall and sealing it thereto. The second or top end is partially sealed by having a first rear wall portion folded over a lateral axis and sealed to an opposed front wall portion. A second rear wall portion extends longitudinally beyond the longitudinal termination of the front wall portion to form the sleeveless valve with the opposed front wall portion. The tube is longitudinally creased so as to form the front and rear walls of a tube or reverse creased to form front and rear walls with a pair of gussets deposed therebetween. The gusset between the rear wall portion and opposed front wall portion has stepped longitudinal termination between the longitudinal termination of the front and rear walls. The gusset continguous to the second rear wall portion forms a part of the longitudinal sleeveless valve.

The first and second rear wall portions are formed in a single ply bag by not sealing the longitudinal seam completely and in a plural ply bag by two longitudinal cuts. The first longitudinal cut severs the outer ply of the rear wall and second longitudinal cut, which is displaced laterally from the first longitudinal cut and is at the edge of the valve opening, severs the interior ply of the rear wall portion. The two longitudinal cuts provide an outer ply of the second rear wall portion which extends laterally across the sealed portion so as to overlap the sealed portion when the second rear wall portion is folded over and sealed to its opposed front wall portion; thereby providing a more perfect seal of the valve. The two longitudinal rear wall cuts and a front wall cut, corresponding to the second rear wall cut, all extend down to the folding line which lies along the lateral axis previously described. The pre-sealed first rear wall portion provides a reference to the lateral axis such that the second rear wall portion may be folded along this lateral axis.

The bag construction of the present invention provides a bridge between the valve and open mouth bags of the prior art usable in both types of filling operation with improved results.

The bag of the present invention provides a valve which is sleeveless and can be heremetically sealed, automatically, and at any speed of production considerably in excess of a conventional valve bagging operation.

By using a longitudinal valve, the sealing technique of plastic lined, open mouth bags can be used to provide a heremetical seal. The use of the gusset to increase and standardize the valve opening is also possible while increasing the filling speed over conventional valve bags. This construction also simplifies the bag manufacturing operations and bag filling and sealing equipment.

Due to the construction and location of the opening in the new bag, the new bag can be filled with greater degree of weight accuracy of both granular free flowing materials and fine powders.

Due to the construction and location of the opening in the new bag and the pre-sealing of most of the bag top, less paper is used in the construction of the bag for a given volume of material to be contained in comparison to conventional valve bags. The efficiency of utilizing the available bag volume is enhanced by eliminating the sleeve, orientation of the fill opening to the longitudinal axis of the bag and method of closure.

Due to the small linear dimension (in the flat folded condition) of the opening and its location at the top of the new bag for filling, compared to the side opening as in prior art valve bags, the reforming of the one gusset and folding of this short length of opening top for sealing is easily and readily accomplished with greatly increased reliability of a leakproof and siftproof and air tight seal.

Due to the construction of the bag opening and the location of the opening in relation to the longitudinal axis of the bag, the new bag lends itself readily to a fully automatic bag placing, opening, filling and sealing system that can be made available economically for speeds of 12 or less bags per minute or avialable to operate at speeds up to 50 bags per minute.

Compared to the open mouth bags, the bag of the present invention will fill, under certain conditions, at the same rate. As a result of the new bag construction it is possible to achieve a fully, automatic closure with greatly increased reliability at speeds much higher than existing fully automatic pinch style systems with equipment that is considerably less complicated.

Due to the pre-sealing along most of the bag top width and the method of filling, the present bag reduces the freeboard need to eliminate buckling of the front and rear walls and reform the gussets as filled before sealing and thereby reduces the amount of paper needed to package a given volume of product.

Since the bottom and most of the top of the bag of the present invention is pre-sealed and the fill opening comprises a small portion of the front and rear wall width, the opening is readily and positively sealed without misalignment.

Other objects, advantages, and novel features of the present invention will become apparent from the following detailed description of the invention when considered in conjunction with the accompanying drawings.

BRIEF DESCRIPTION OF THE DRAWINGS

FIG. 1 is a perspective view of a lateral valve bag of the prior art.

FIG. 2 is a perspective view of an open mouth bag of the prior art in the open condition.

FIG. 3 is a perspective view of an open mouth bag of the prior art in the sealed condition.

FIG. 4 is a perspective view of an open mouth bag of the prior art being held during filling.

FIG. 9 is a perspective view of a sleeveless valve bag embodying the principles of the present invention and formed from the gussetted bag of FIG. 8.

FIG. 10 is a perspective view of a sleeveless valve bag of the present invention being held during filling.

FIG. 11 is a perspective view of a laterally interior sleeveless valve bag embodying the principles of the present invention.

FIG. 12 is a perspective view of plural ply bag with a plastic lining embodying the principles of the present invention.

FIG. 13 is a perspective view of a single ply, gussetted bag modified according to the present invention.

FIG. 14 is a perspective view of a sleeveless valve bag formed from the gussetted bag of FIG. 13.

FIG. 15 is a perspective view of a sleeveless valve bag formed from a tube style, open mouth bag embodying the principles of the present invention.

FIG. 16 is a perspective view of a sleeveless valve bag embodying the principles of the present invention.

FIG. 17 is a perspective view of a bag having a pair of sleeveless valves embodying the principles of the present invention.

DESCRIPTION OF THE PREFERRED EMBODIMENTS

Figure 5:
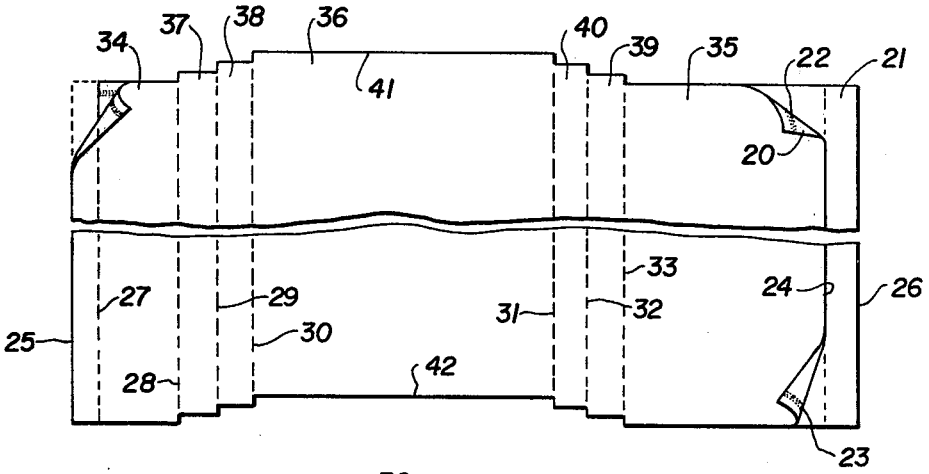
FIG. 5 PRIOR ART
FIGS. 5, 6 and 7 are views of the process of forming a gussetted, plural ply bag into a tube with a sealed bottom according to the prior art.
Figure 6:
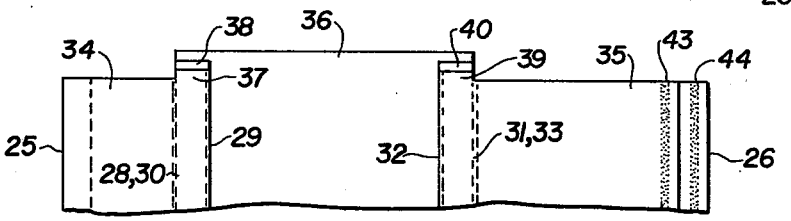
FIG. 6 PRIOR ART

FIG. 5 illustrates a blank of the prior art from which a gussetted bag is formed having two plies 20 and 21 of flexible material, such as kraft or other type paper glued together at 22 and 23. The lateral edges 24 and 25 of ply 20 are stepped relative to the lateral edges 26 and 27 of ply 21 so as to overlap and form a smooth longitudinally sealed tube as will be explained. The blank is longitudinally creased at 28, 29, 30, 31, 32, 33 to form front panels 34 and 35, rear panel 36 and gusset panels 37, 38, 39, 40. The top longitudinal edge 41 of the blank is stepped down from rear panel 36 to the front panels 34 and 35. The opposite or bottom longitudinal edge 42 is stepped down in the reverse order between rear panel 36 and front panels 34 and 35. Gusset panels 37, 38 and 39, 40 are reversely folded along longitudinal creases 29, 30 and 31, 32 as illustrated in FIG. 6. Front panels 34 and 35 are reverse folded about longitudinal creases 28 and 33 respectively so that the lateral edges of the blank are bonded together by adhesive strips 43 and 44 when the lateral edges 25 and 26 of the blank overlapped. This longitudinal seal is illustrated in FIGS. 7 and 8.

Figure 7:
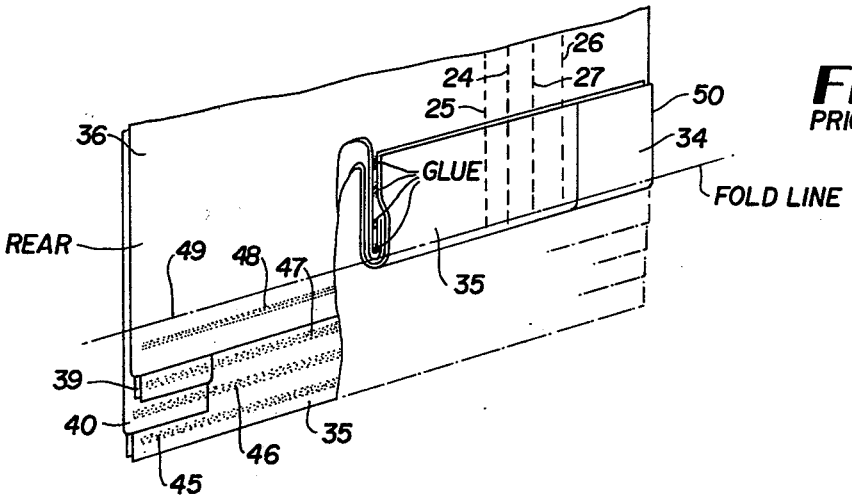
FIG. 7 PRIOR ART
Figure 8:
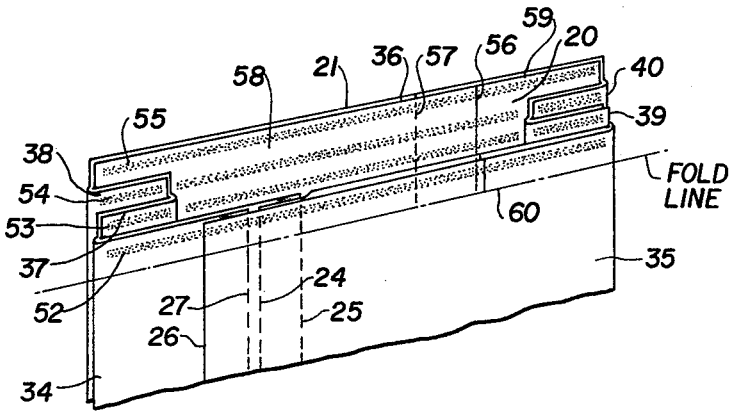
FIG. 8 is a perspective view of the gussetted bag of FIGS. 5, 6 and 7 modified according to the present invention.

Four strips of adhesive materials 45, 46, 47 and 48 are applied to the bottom edge of the blank illustrated in FIG. 7 and the front wall panels 34 and 35 are folded along fold line 49 to bring the front wall panels 34 and 35 and the step end of gusset panels 37, 38, 39 and 40 adjacent the rear panel 36 to be sealed at 50. The process so far described in FIGS. 5, 6 and 7 to form a tubular shaped bag having longitudinal creases to form a front and rear panel having gusset panels disposed there-between and being sealed at one end are well known and considered part of the prior art as exemplified by U.S. Pat. No. 4,008,850. As also is well known in the prior art four adhesive strips 52, 53, 54 and 55 are applied to the top edges as illustrated in FIG. 8.

The bag of the prior art being of tubular shape having a sealed bottom and adhesive areas on the open top edge is modified according to principles of the present invention to provide a sleeveless valve bag. The exterior ply 21 of rear panel 36 is cut along longitudinal line 57 and interior ply 20 of rear panel 36 is cut along longitudinal axis 56 dividing the rear panel 36 into first rear panel portion 58 and second rear panel portion 59. The front panel 35 is also cut through both plies along longitudinal line 56. The length of the longitudinal cut along axis 56 and 57 are from the top edge of the front and rear panels down to the fold line 60 in the front and rear panels. The first rear panel portion 58 is folded along fold line 60 and sealed to the front panels 34 and 35 at 61 using adhesive strips 52, 53, 54, and 55 as shown in FIG. 9. Additional adhesive is added to extend strips 52, 53, 54, 55 to the inner surface of exterior ply 21 of rear wall portions 59.

As can be seen in FIG. 9, the exterior ply 21 of rear wall portion 59 extends laterally across the sealed first rear wall portion 58. The extension of exterior ply 21 of rear wall portion 59 beyond interior ply 20 is equal to the extension of interior ply 20 of rear wall portion 58 beyond the termination of exterior ply 21 of portion 58. The importance of the equality of the extension of the two lateral portions is such that when the second rear wall portion 59 is folded along fold line 60 when the bag is filled and sealed to the front wall panel 35, the exterior ply 21 of rear wall portion 59 is adjacent to exterior ply 21 of rear wall portion 58 to form a continuous surface thereby avoiding an edge which may be caught and thereby damage the exterior ply and seal. The main purpose of even forming exterior ply 21 of rear wall portion 59 extending laterally past the termination of interior ply 20 is to cover and seal the inside edge or point 62 of the open portion of the valve and thereby prevent a pinpoint leak through the finally sealed top. For certain materials, the pinpoint opening 62 is not critical. For these materials, a single cut 56 is sufficient. Similarly, a single cut 56 could be used and a separate patch is added to the second rear wall portion 59 to function as the extended exterior ply to cover edge 62.

The bag illustrated in FIG. 9 embodies a pinch type tubular bag being sealed at one end and partially sealed at the other end so as to have a longitudinal sleeveless valve formed between rear wall portion 59 and opposed front wall panel 35 and includes the gusset panels 39 and 40. The sleeveless valve after filling is capable of being sealed by folded along the lateral fold line 60 which is reference to the pre-folded rear wall section 58. The valve is capable of being sealed so as to be leak and sift proof and to prevent insect infestation.

The advantage of the bag of FIG. 9 is illustrated in FIG. 10 wherein the gussetted panels 39 and 40 are open to increase the size of the valve without occupying a major portion or width of the front and rear panels. The pre-sealed rear wall portion 58 consitutes a substantial portion or greater than a majority of the width of the bag. Preferably the section 58 constitutes at least 75 percent of the width. This percentage is based on a preferred fill diameter of 3¾ inches of bags having widths of 15 to 17 inches with gussets of 3 to 5 inches requiring a linear lateral length of 4 to 4¼ inches of the front or rear panels. The importance of the pre-sealed section is that top edge 63 provides a reference of the fold line 60 which is displaced from the top edge 63 by the thickness of the plies. The bag may be filled at any angle since a lateral reference 63 is provided for the forming of the seal for the second rear portion 59. Similarly, by having section 58 constitute a substantial portion of the top, buckling, wrinkles and other problems of open mouth bags are reduced since a majority of the seal is formed prior to filling.

A comparison between FIGS. 4 and 10 will illustrate that the fill line of FIG. 10 is far higher than the fill line of FIG. 4 therefore allowing greater use of the capacity the bag. The ability to fill higher in FIG. 10 versus FIG. 4 is because of the edge 63 of pre-folded top section 58 provides a reference of the lateral axis 60 and it reduces reforming problem and consequently the holding of the bag by the clamps during filling and at the sealing station may be placed at the top of the bag thereby reducing the freeboard.

In the preferred embodiment, the second rear portion 59 is contiguous a gussetted side to provide maximum fill opening per linear lateral dimension of the face panels by using the gusset. Alternatively, the longitudinal sleeveless valve may be spaced from the side panels as illustrated in FIG. 11. Two sealed rear portion 64 define a valve having a third rear portion 65. Not only does the embodiment of FIG. 11 not make efficient use of the available bag material but doubles the cuts needed to seal the edge of the valve.

If reduction of wrinkle or warp top surfaces are not a concern, the sealed or first rear portion 58 may be a very small portion of the top width and the second rear portion 59 a substantial portion. The only limitation on the width of portion 58 is that it be long enough to provide a reference edge 63 for fold axis 60 and preferably an area to be clamped during filing.

Although the modification of the tube shaped bag of the prior art has been described having cuts 56 and 57 made after the formation of the tube formed in FIGS. 5 through 7, the cuts of the front panel 35 and rear panel 36 may be made during the cuts needed to form the blank in FIG. 5. The rear panel's exterior ply 21 is cut along line 57 and interior ply 22 is cut along line 56. The front panel 35 is cut along a line which will coincide with line 56 when folded into a tube. Also, the adhesive strips including the extension onto the inner surface of exterior ply 21 may all be forward at the same time or process step.

The sleeveless valve bag of the present invention may have the capability of forming a hermetical seal as illustrated in FIG. 12 by being formed from a three ply tubular bag. The outer ply 70 and middle ply 71 are of kraft or other types of paper and the inner ply 72 is a plastic for example, polyethelene. The bottom of front wall 73 is sealed to rear wall 74 at 75 by heat sealing and adhesive. Adhesive strips 76 are provided on the top edge, as is well known in the prior art. At least the inner ply 72 of rear wall 74 is cut along longitudinal axis 77 and at least the outer ply 70 of rear wall 74 is cut along longitudinal axis 78. The middle ply 71 may be cut along axis 77 and 78 or in the alternative may be cut along a third longitudinal axis between axis 77 and 78. The cuts along axis 77 and 78 divide the rear wall 74 into rear wall portions 80 and 81. The first rear wall portion 80 is heat sealed along heat seal line 82, then it is folded along fold line 83 and sealed by adhesive 76 to the front wall 73. This provides the partially sealed top having a reference along lateral fold axis 83 and produces the sleeveless valve comprising rear wall portion 81 and opposed front wall portion 73. After filling through through the valve it is heat sealed along axis 82 and then folded along lateral axis 83 and bound by adhesive 76 to the front wall 73. The operation and function of the elements of FIG. 11 are identical to those described in FIGS. 8 and 9 with the improved results of forming an hermetical seal because of the polyethelene or plastic liner interior ply 72. It should be noted that in lieu of a plastic liner 72, an interior paper ply may be used and it may be coated with a plastic. As is well known in the prior art the heat seal 82 which binds the front and rear panels of interior ply 72 together is longitudinally above the fold line 83 and therefore is protected by the fold and seal thereof.

The sleeveless valve of the present invention can be formed in a single ply tube. As illustrated in FIGS. 13 and 14, a single ply 90 is creased longitudinally and folded to form front panel 91, side gussets 92 and 93, and rear panels 94 and 95. The rear panels overlap and are sealed along the length of the bag except for the height above the top edge 96 of the front panel 91. This provides the two rear wall portion extending beyond the front wall termination 96 which overlaps without cutting. The rear panel 94 is folded along top edge 96 over the front panel 91 and sealed thereto at 97 by adhesive strips 98 (only one of which is shown). It should be noted that by not cutting or folding the front panel 91 a good seal is formed, but not as good as the seal of FIG. 9. If desired, the bags of FIGS. 9 and 12 may not include a cut in the front panels and the fold line be the top edge of the front panel. Similarly, the front panel in FIG. 14 may be cut and the fold line may be below the top edge 96.

A non-gusset tube bag is illustrated in FIG. 15 as including a front panel 100 separated from a rear panel by two longitudinal creases 102 and 103. The bag is two ply having the rear panel 101 cut along lines 104 and 105 to form two rear portions 106 and 107 having overlapping ply elements. Front panel 100 is also cut along line 105. Rear portion 107 is folded about fold line 108 and sealed to front panel 100 at 109. A longitudinal sleeveless valve is formed by rear portion 106 and opposed front panel. The seal produced for a non-gussetted tube bag is sufficient for some uses, but is not considered as good as the seal for stepped gussetted bags of FIGS. 9 and 12. The bag of FIG. 15 does not have the advantage of the gusset to increase the valve opening. Similarly, FIG. 15 illustrates that the valve rear panel portion 106 may constitute a larger percentage of the bag width than the seal rear panel portion 107 if so desired, though not preferred.

Another embodiment of the longitudinal sleeveless valve is illustrated in FIG. 16 wherein the front wall panel 110 and gussets 111 are the same longitudinal length as the rear panel 112. The seal produced in this embodiment is not considered as good as those where the front panel and gussets are stepped relative to the rear panel as in FIG. 8.

A pair of sleeveless valves may also be provided as illustrated in FIG. 17. A first rear wall portion 115 is sealed to the front wall 116 and a pair of second rear wall portions 117 and 118 extend beyond the seal portion forming a pair of sleeveless valves with respective gussets 119 and 120. The second rear wall portions each have a lateral extension, preferably an outer ply which extend across the sealed rear wall portion 115.

The versatility of the sleeveless valve is illustrated by the variance of placement of FIG. 11 and the variance of number of FIG. 17. Similarly, the style of bag and the location of the fold line may also be varied as illustrated, depending upon the type of seal desired.

From the preceding description of the preferred embodiment, the objects of the invention are attained in that a sleeveless valve bag having a longitudinal filling valve is provided which is capable of being sealed without misalignment to provide a leak proof, sift proof, and insect infestation proof bag. Although the invention has been described and illustrated in detail, it is to be clearly understood that the same is by way of illustration and example only and is not to be taken by way of limitation. The bags have been described as being made of paper, but the invention may be practiced with plastic bags whether tube or gussetted. The spirit and scope of this invention is to be limited only by the terms of the appended claims.

I claim:

1. A bag having a sleeveless longitudinal filling valve comprising a tube closed at one end, longitudinal creases forming front and rear walls, a first rear wall portion being folded along a lateral axis and sealed to said front wall for providing a reference of said lateral axis, and a second rear wall portion extending longitudinally beyond said lateral axis for forming with opposed front wall portion said longitudinal valve, said bag includes at least two plies of flexible sheet material, the outer ply of said second rear wall portion extends laterally beyond the termination of the inner ply of said first rear wall portion, said longitudinal valve being closable by folding said second rear wall portion along said lateral axis and sealing said second rear wall portion to said opposed front wall portion with the outer ply of said extended second rear wall portion superimposed on the inner ply of said first rear wall portion to provide a leak and sift proof and insect impervious bag.

2. A bag having a pair of sleeveless longitudinal filling valves comprising a tube closed at one end, longitudinal creases forming front and rear walls, a first rear wall portion being folded along a lateral axis and sealed to said front wall for providing a reference of said lateral axis, and a second and third rear wall portion each extending longitudinally beyond said lateral axis and each extending laterally from opposite lateral edges of said rear wall toward said first rear wall portion for forming with opposed front wall portion said pair of longitudinal valves, said longitudinal valves being closable by folding said second and third rear wall portions along said lateral axis and sealing said second and third rear wall portions to said opposed front wall portions to provide a leak and sift proof and insect impervious bag.

3. The bag according to claim 2 wherein each of said second and third rear wall portions include a lateral projection extending across a respective portion of said first rear wall portion.

4. A bag of tubular form closed at one end and partially closed at the other end, comprising longitudinal, reversed creases along portions of said bag providing at least one gusset between front and rear wall portions, a first rear wall portion being sealed to said front wall portion froming the closed portion of said other end, a second rear wall portion extending upwardly at the open portion of said other end, said bag includes at least two plies of flexible sheet material, the outer ply of said second rear wall portion extends laterally beyond the termination of the inner ply of said first rear wall portion; said gusset extending upwardly at said open portion beyond said front wall portion and terminating below the termination of said second rear wall portion, said second rear wall portion and opposed front wall portion and said gusset forming a sleeveless longitudinal filling valve.

5. The bag according to claim 2 wherein said first rear wall portion is sealed along at least 51 percent of the width of said front wall portion.

6. A sleeveless valve bag comprising a tube closed at one end, longitudinal creases forming front and rear walls on said tube, a first rear wall portion and a portion of the top of opposed front wall are folded over said front wall and sealed thereto at the other end, a second rear wall portion extending longitudinally beyond said front wall at said other end forming a longitudinal valve between said second rear wall portion and opposed front wall portion, said opposed front wall portion extends longitudinally beyond the top of said seal and terminates below the termination of said second rear wall portion.

7. The sleeveless valve bag according to claim 6 wherein said second rear wall portion extends laterally across a portion of said first rear wall portion.

8. A bag of tubular form closed at one end and partially closed at the other end, comprising longitudinal, reversed creases along portions of said bag providing at least one gusset between front and rear wall portions, a first rear wall portion and a portion of the top of opposed front wall being folded over said front wall and sealed to said front wall portion forming the closed portion of said other end, a second rear wall portion extending upwardly at the open portion of said other end, said gusset extending upwardly at said open portion beyond said front wall portion and terminating below the termination of said rear wall portion, said second rear wall portion and opposed front wall portion and said gusset forming a sleeveless longitudinal filling valve.

9. The bag according to claim 8 wherein said gusset includes two panels, the panel contiguous said opposed front wall portion terminates below the termination of the panel contiguous said second rear wall portion whereby said valve is capable of forming a leak proof, sift proof and insect impervious seal.

10. The bag according to claim 8 wherein said bag includes at least two plies of flexible sheet material, the outer ply of said first rear wall portion terminates laterally before the termination of the inner ply of said first rear wall portion and said inner ply of said second rear wall portion terminates laterally before the termination of the outer ply of said second rear wall portion.

11. The bag according to claim 10 wherein the lateral termination of said outer ply of said first and second rear wall portions and the inner ply of said first and second rear wall portion are respectively aligned longitudinally.

12. A bag having a sleeveless longitudinal filling valve formed from a single blank comprising a tube closed at one end, longitudinal creases forming front and rear walls, a first rear wall portion of said blank unitary to said tube being folded along a lateral axis and sealed to said front wall for providing a reference of said lateral axis, and a second rear wall portion of said blank unitary to said tube extending longitudinally beyond said lateral axis for forming with opposed front wall portion said longitudinal valve, said second rear wall portion includes a lateral portion extending across a portion of said first rear wall portion, said longitudinal valve being closable by folding said second rear wall portion along said lateral axis and sealing said second rear wall portion to said opposed front wall portion to provide a leak and sift proof and insect impervious bag.

13. The bag according to claim 12 wherein said bag is single ply sealed along a longitudinal seam formed from two superimposed sections, said first and second rear wall portions are non-sealed extensions of said superimposed sections.

14. The bag according to claim 12 wherein said first rear wall portion includes two sections, each extending laterally from opposite longitudinal edges of said rear wall toward said rear wall portion and said second rear wall portion includes lateral portions each extending across a portion of a respective section of said first rear wall portion.

15. The bag according to claim 12 wherein second rear wall portion extends laterally from a longitudinal edge of said rear wall.

16. The bag according to claim 15 including longitudinal creases forming a pair of gussets deposed between said front and rear walls, the gusset contiguous said second rear wall portion forming part of said longitudinal valve.

17. The bag according to claim 12 wherein said bag includes at least two plies of flexible material, the outer ply and inner ply of said rear wall are severed along spaced longitudinal axes to form said first and second rear wall portions having adjacent stepped lateral terminations.

18. The bag according to claim 17 wherein the outer ply of said second rear wall portion extends laterally beyond the termination of the inner ply of said first rear wall portion.

19. A sleeveless valve bag comprising a tube closed at one end, longitudinal creases forming front and rear walls on said tube, a first rear wall portion being sealed to said front wall at the other end, a second rear wall portion extending longitudinally beyond said front wall at said other end forming a longitudinal valve between said second rear wall portion and opposed front wall portion, said tube including at least two contiguous plies of flexible sheet material, the outer ply of said second rear wall portion extending laterally beyond the termination of the inner ply of said second rear wall portion.

20. The sleeveless valve bag according to claim 19 wherein the lateral termination of said outer ply of said first and second rear wall portions and the lateral termination of said inner ply are respectively of said first and second rear wall portions aligned longitudinally.

21. The method of fabricating a tube bag including cutting a unitary blank and forming the tube from a plurality of plies of flexible material and sealing one end of the tube, the improvement comprising longitudinally cutting the rear wall of said tube, which extends beyond the front wall at the other end of the tube, from the longitudinal termination of said rear wall past the longitudinal termination of said front wall a selected length to divide said rear wall into a first and second rear wall portion and longitudinally cutting the front wall from its longitudinal termination said selected length, folding said first rear wall portion and adjacent front wall over said front walls, and sealing said first rear wall portion to said front wall while maintaining said second rear wall portion in an unfolded condition to form a sleeveless valve at the opening between the front wall and said second rear wall portion.

22. The method according to claim 21 wherein said longitudinal cutting is performed before forming said tube.

23. The method of fabricating a tube bag including cutting a unitary blank and forming the tube from a plurality of plies of flexible material and sealing one end of the tube, the improvement comprising longitudinally cutting the inner and outer plies of the rear wall of said tube, which extends beyond the front wall at the other end of the tube, along spaced longitudes from at least the longitudinal termination of said rear wall to the longitudinal termination of said front wall to divide said rear wall into a first and second rear wall portion, folding said first rear wall portion over said front wall and sealing said first rear wall portion to said front wall while maintaining said second rear wall portion in an unfolded condition to form a sleeveless valve at the opening between the front wall and said second rear wall portion.

24. The method according to claim 23 wherein said longitudinal cutting is performed after forming said tube.

25. The method according to claim 23 wherein the longitudinal cutting of the outer ply is spaced from the lateral edge of the seal of said first rear wall portion forming a portion of the outer ply of said second rear wall portion which extends laterally beyond said lateral edge of said seal.

26. The method according to claim 23 wherein said sealing includes folding said first rear wall portion along a lateral axis providing a reference for folding said second rear wall portion.

* * * * *

UNITED STATES PATENT AND TRADEMARK OFFICE

CERTIFICATE OF CORRECTION

PATENT NO. : 4,142,667

DATED : March 6, 1979

INVENTOR(S) : William Runo

It is certified that error appears in the above-identified patent and that said Letters Patent are hereby corrected as shown below:

Column 1, line 54, Delete "heremetical" and insert —hermetical—.
line 65, Delete "maintains" and insert —maintain—.
Column 2, line 54, Delete "heremetically" and insert —hermetically—.
line 60, Delete "heremetical" and insert —hermetical—.
Column 3, line 22, Delete "avialable" and insert —available—.
line 27, Delete "," after "fully"
Column 4, line 66, Delete "cut" and insert —cuts—.
line 67, Delete "are" and insert —is—.
Column 5, line 37, Delete "folded" and insert —folding—.
line 38, Delete "reference" and insert —referenced—.
line 66, Delete "of", first occurrence.
line 68, Delete "problem" and insert —problems—.
Column 6, line 9, Delete "portion" and insert —portions—.
line 14, Delete "are" and insert —is—.
line 21, Delete "filing" and insert —filling—.
Column 7, line 8, Delete "portion" and insert —portions—.
line 16, Between "line" and "be" insert —may—.
Column 8, line 2, Delete "is" and insert —are—.
line 47, Delete "froming" and insert —forming—.

Signed and Sealed this

*Seventh* Day of *August 1979*

[SEAL]

*Attest:*

*Attesting Officer*

LUTRELLE F. PARKER

*Acting Commissioner of Patents and Trademarks*